United States Patent [19]

Tenner

[11] 4,345,121

[45] Aug. 17, 1982

[54] MINIATURE LIGHTED PIVOTED ACTUATOR SWITCH WITH INTEGRAL LOCK

[75] Inventor: Richard B. Tenner, Oak Creek, Wis.

[73] Assignee: Eaton Corporation, Cleveland, Ohio

[21] Appl. No.: 245,429

[22] Filed: Mar. 19, 1981

[51] Int. Cl.[3] ..... H01H 27/00

[52] U.S. Cl. ..... 200/42 R; 200/42 T; 200/325; 200/339

[58] Field of Search ..... 200/42 R, 42 T, 316, 200/318, 321, 323, 325, 327, 330, 331, 339, 67 G

[56] References Cited

U.S. PATENT DOCUMENTS

| | | | |
|---|---|---|---|
| 2,503,226 | 4/1950 | Turner et al. | 200/157 |
| 3,598,162 | 8/1971 | Rosenthal, Jr. | 200/44 |
| 3,626,118 | 12/1971 | Botefuhr | 200/42 R |
| 3,694,598 | 9/1972 | Nishikawa et al. | 200/67 G |
| 3,746,815 | 7/1973 | Dummer | 200/157 |
| 3,996,441 | 12/1976 | Ohashi | 200/309 |
| 4,013,858 | 3/1977 | Grebner et al. | 200/42 T |
| 4,174,472 | 11/1979 | Josemans | 200/68 |

*Primary Examiner*—Willis Little

*Attorney, Agent, or Firm*—C. H. Grace; W. A. Autio

[57] ABSTRACT

A miniature toggle switch having an actuator (20) pivotally mounted in a base (2) for operating contacts (8, 10, 12, 16). A switch lock is provided by a one-piece leaf spring (34) press-in mounted at one end in a slot (20*f*) in a side ledge of the actuator so that its other end abuts a shoulder (2*g*) in the base to lock the switch in one position. This lock spring is provided with a knee bend (34*c*) that sticks out beyond and below the actuator ledge (20*d*) in which it is mounted. A removable operating lever (26) has a pair of hooks (26*a*, 26*b*) for snap-on mounting it on the side ledges of the actuator. One of these hooks engages the knee bend (34*c*) of the lock spring to bias it clear of the shoulder (2*g*) to allow normal switch operation. A lamp (28) is mounted in the bottom of the base and extends up through a hole (20*c*) in the actuator to light the operating lever (26) as an indication.

6 Claims, 4 Drawing Figures

MINIATURE LIGHTED PIVOTED ACTUATOR SWITCH WITH INTEGRAL LOCK

BACKGROUND OF THE INVENTION

Miniature lighted switches as well as switches with integral off-locks have been known heretofore. For example, Shigeo Ohashi U.S. Pat. No. 3,996,441, dated Dec. 7, 1976, shows a miniature lighted double-pole rocker switch having a rocker actuator and a lamp bulb mounted in the switch base and extending partway up within the actuator to provide an indication through the actuator. Also, Francis J. Rosenthal, Jr., U.S. Pat. No. 3,598,162, dated Aug. 10, 1971, shows a switch interlock wherein a spring strip normally is in the path of the switch operating lever but when a key is inserted into an aperture in the switch housing, it pushes the spring strip out of the way to allow operation of the rocker lever. Furthermore, Leonardus J. Josemans U.S. Pat. No. 4,174,472, dated Nov. 13, 1979, shows a pivoted actuator switch with integral off-lock have a spring-biased pivotal lug mounted within the switch contact actuator so as to normally stick out and catch on the switch frame, but when the removable operating lever is inserted in place, it cams the lug out of the way to allow free operation of the switch. While these prior switches have been useful for their intended purposes, this invention relates to improvements thereover.

SUMMARY OF THE INVENTION

An object of the invention is to provide an improved miniature lighted switch with integral lock.

A more specific object of the invention is to provide a miniature pivoted actuator switch with an improved lock.

Another specific object of the invention is to provide an electric switch with a lock that is simple in construction and economical to assemble.

Another specific object of the invention is to provide an improved miniature removable-lever switch having an off-lock that allows actuation from on to off when the lever is removed but requires reinstallation of the lever to allow operation from off to on.

Another specific object of the invention is to provide an electric switch with a one-piece lock that affords push-in assembly.

Another specific object of the invention is to provide an electric switch with a remove-to-lock operating lever and an improved lock that is effectively concealed to avoid defeating the locked state except by reinstallation of the operating lever.

Other objects and advantages of the invention will hereinafter appear.

DESCRIPTION OF THE PREFERRED EMBODIMENT

Figure 1:
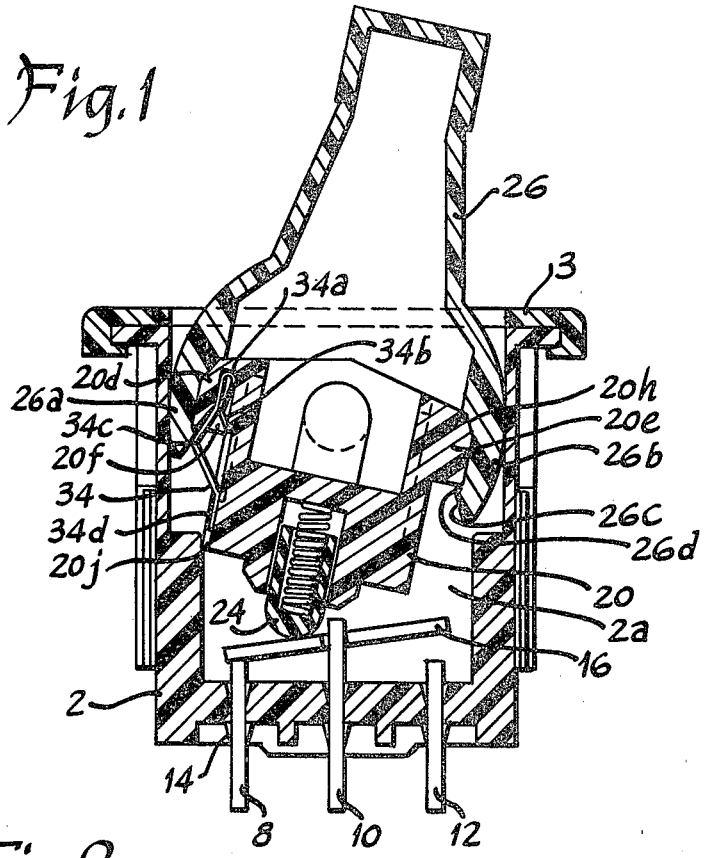
FIG. 1 is an enlarged cross-sectional view through one pole of a double-pole switch of the miniature lighted pivoted actuator type showing also the lock mechanism in its unlocked state.
Figure 3:
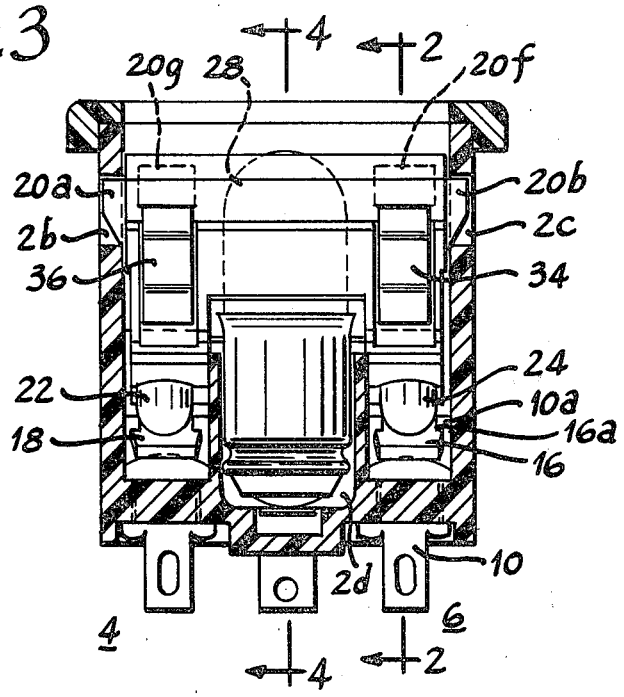
FIG. 3 is a cross-sectional view taken substantially along line 3—3 of FIG. 2 showing the two poles of the switch, the lamp bulb therebetween and the lock.

Referring to FIGS. 1 and 3, there is shown a miniature lighted pivoted actuator switch with integral lock constructed in accordance with the invention. As shown therein, the switch is provided with a molded insulating base 2 having a compartment 2*a* therein for housing the switch contacts, actuator block and indicator lamp. A snap-on bezel 3 of a selected color is mounted to the upper rim of the base. This double-pole switch has two sets of switch contacts or poles 4 and 6 as shown in FIG. 3, there being three contacts in each set as shown in FIG. 1. These contacts in each set are provided by three contact-terminals including a left contact terminal 8, a higher central contact terminal support or contactor support 10, and a right contact terminal 12 as shown in FIG. 1. These contact terminals extend through holes in the bottom of the base and are staked to rigidly secure them to the bottom of the base so that the upper ends thereof form stationary contacts within the base compartment and the lower ends thereof provide terminals to connect the switch to an external circuit. Epoxy 14 may be placed around these contact terminals if necessary to fix them to the bottom of the base.

This double-pole switch also has a pair of contactors 16 and 18, one for each set of stationary contacts or pole of the switch as shown in FIG. 3. To support this contactor, it has a pair of notches 16*a*, FIG. 3, on its opposite edges at the center for retention on the U-shaped upper end 10*a* of contactor support 10. This construction keeps the contactor from excessive sliding left or right in FIG. 1 but allows it to be rocked by the contact actuator 20 to bridge the center contact terminal to either the left or right contact terminal.

There are provided means for pivotally supporting actuator 20 within base 2. For this purpose, the base is provided with a pair of round holes 2*b* and 2*c*, one in each of the opposite walls of the base, and the actuator is provided with a pair of short trunnions 20*a* and 20*b*, one on each side, as shown in FIG. 3, these trunnions having beveled lower sides that act as cams to allow the actuator to be pressed down into the base compartment so that the trunnions snap into holes 2*b* and 2*c* to support the actuator for pivotal movement in the base. Since the base is molded of plastic material, it will flex enough to allow the actuator including its trunnions to enter between the walls thereof.

Figure 4:
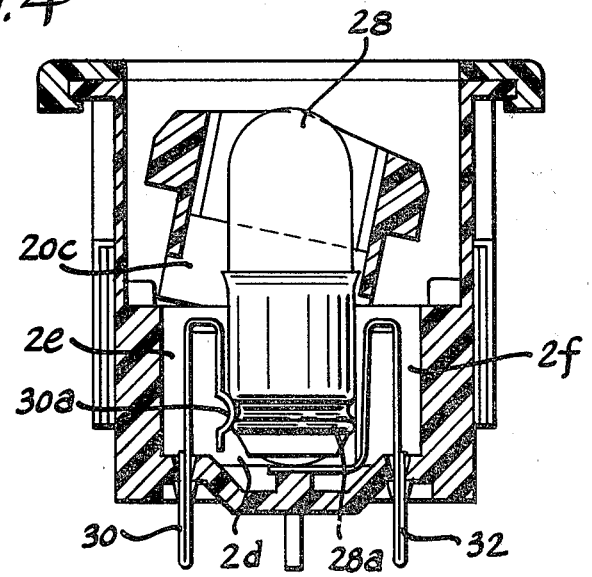
FIG. 4 is a cross-sectional view taken substantially along line 4—4 of FIG. 3 showing the lamp bulb and its connector terminals.

This actuator is provided with resilient means for actuating the contactors. This means comprises a pair of spring-biased plungers 22 and 24 retained in upwardly-extending blind holes at opposite ends of the actuator as shown in FIGS. 1 and 3. These spring-biased plungers resiliently press down on the contactors and slide therealong when operating lever 26 is swung from one position to another. This actuator 20 is also provided with means for accommodating an indicator lamp 28 as shown in FIGS. 3 and 4. This means comprises a rectangular hole 20*c* extending up through the middle of the actuator. This lamp is mounted in a socket 2*d* in the bottom of the base and extends up through rectangular hole 20*c* to light the operating lever. Hole 20*c* is longer in the rocking direction of the actuator than it is wide so that the lamp will not impede the rocking movement of the actuator.

As shown in FIG. 4, socket 2*d* has a pair of wing sockets 2*e* and 2*f* extending therefrom in opposite directions to accommodate lamp terminals 30 and 32. These lamp terminals extend through holes in the bottom of the base and are retained therein by locking tabs. Terminal 30 extends up within wing socket 2*e* and is bent back down along the lamp bulb and is provided with a bump 30*a* that engages a groove 28*a* around the lamp bulb base to make electrical contact with one terminal of the lamp bulb and to hold it in place. Terminal 32 extends up within wing socket 2*f* and then back down to pinch the lamp bulb between the two terminals and beneath the lamp bulb base to make electrical contact with the other, center terminal of the lamp bulb.

This switch is also provided with means for locking the actuator in its off position. This means comprises a lock spring 34 mounted to the actuator and a shoulder or catch 2*g* within the base on which the lower end of the lock spring catches or abuts to lock the switch against operation to the other position. While this lock has been characterized as an off-lock, it will be apparent that it may be used to lock the switch in one of two operating positions. The base is molded with another shoulder 2*h* on the other side as shown in FIG. 2 so that the actuator may be assembled in either direction and the lock will be effective.

The actuator is provided with means for mounting the lock spring so that it will automatically become effective when the operating lever is detached and will be defeated or rendered ineffective when the operating lever is snapped back on. Also, the lock spring is mounted so that it is concealed from view at all times and thus is not likely to be defeatable by a pin or other tool when the operating lever has been removed. For snap-on retaining the operating lever, the actuator is provided with a pair of ledges 20*d* and 20*e*, one on each side. For retaining the lock spring, a slot 20*f* is provided under ledge 20*d*. Lock spring 34 is provided with bent back portion 34*a* at one end that may be squeezed to press it in the slot 20*f*. To retain this lock spring in its slot, the extreme end portion 34*b* of this bent back end is bent outwardly so that it bites into the actuator and prevents it from coming out of its slot.

Figure 2:
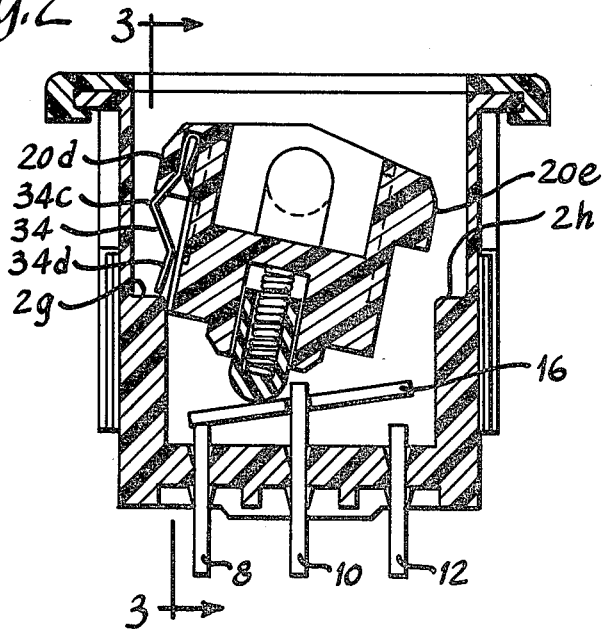
FIG. 2 is a view like FIG. 1 but with the operating lever removed, taken substantially along line 2—2 of FIG. 3, and showing the lock in its locked state.

The other end portion of this lock spring is provided with a knee bend 34*c* that will stick out unnoticeably slightly beyond and below ledge 20*d* when the operating lever is removed as shown in FIG. 2. Also, under such condition, the extreme end 34*d* of this locking spring will have swung out over shoulder 2*g* whereby this shoulder provides interference to prevent operation of the actuator. In other words, end 34*d* of the spring will abut the shoulder if attempt is made to operate the switch so as to prevent operation thereof.

While a single lock spring is normally sufficient to provide the switch locking feature, a second lock spring 36 may be used as shown in FIG. 3. The double-pole actuator 20 is provided with two spring slots 20*f* and 20*c* as shown in broken lines in FIG. 3, one such slot opposite each plunger 22 and 24. Lock spring 34 is in slot 20*f* and spring 36 is in slot 20*g*. Use of a second lock spring 36 insures that the switch cannot be forcibly operated to its other position.

Operating lever 26 is provided with combined snap-on retention means and lock release means. As shown in FIG. 1, this operating lever is provided with a pair of wide hooks 26*a* and 26*b*, one on each side thereof extending downwardly. These hooks are wide enough to extend substantially all the way across ledges such as ledge 20*d* shown in FIG. 3. Each such hook is provided with a beveled tip such as 26*c* in FIG. 1 leading to a ridge 26*d* that snaps below the lower corner of ledge 20*e* to rigidly secure the operating lever to the actuator. The upper corners of these ledges on the actuator are provided with bevels such as bevel 20*h* in FIG. 1 to facilitate snap-on of the operating lever. To this end, when the operating lever is placed over the actuator and pressed down, lever bevels 26*c* engage actuator bevels 20*h* to resiliently spread the hooks outwardly so as to slide down the actuator ledges whereafter ridges 26*d* thereof snap below the lower corners of these ledges to retain the operating lever on the actuator as a handle for switch operation.

For lock release purposes, the ridge on hook 26*a* engages knee 34*c* of the lock spring to bias it inwardly into shallow groove 20*j* in the actuator. In this position, tip 34*d* of the lock spring is clear of shoulder 2*g* of the base to free the actuator for operation.

Operating lever 26 is preferably provided with two spaced apart vertical slits (not shown) on its hooks 26*a* and 26*b* to enhance their resiliency and facilitate snap-on assembly of the operating lever and snap-off removal while still retaining sufficient stiffness for good retention in place on the actuator.

To remove the operating lever, it is rocked laterally as distinguished from forward and rearward movement thereof in operating the switch. Such lateral rocking to the left or right, with reference to the switch orientation shown in FIG. 3, releases ridges such as 26*d* gradually from beneath the actuator ledges and makes it easier to remove the operating lever. On the other hand, during forward or rearward movement of the operating lever, the latter remains rigidly secured in place.

While the apparatus hereinbefore described is effectively adapted to fulfill the objects stated, it is to be understood that the invention is not intended to be confined to the particular preferred embodiment of miniature lighted pivoted-actuator switches with integral lock disclosed, inasmuch as it is susceptible of various modifications without departing from the scope of the appended claims.

I claim:

1. A self-enclosed miniature pivoted-actuator switch with an integral lock comprising:

a switch housing;

stationary contact means within said housing electrically continuous with external terminals;

movable contactor means within said housing selectively operable between different operating positions closing and opening at least one circuit with respect to said stationary contact means;

an abutment within said housing;

an opening into said housing;

and a switch operator subassembly extending through said opening into said housing for operating said movable contactor means comprising:

an actuator and means pivotally supporting the same in said housing for reciprocal movement to actuate said contactor means;

a resilient locking member and means mounting the same to said actuator at one end portion so that its other end portion abuts said abutment to prevent pivotal operation of said actuator from one operating position to another;

a removable operating lever having a manually engageable external portion to be grasped for operating said switch;

and snap-on means on said operating lever and complemental snap-on means on said actuator for coupling said operating lever and said actuator in an operative relationship, said snap-on means on said operating lever also deflecting said locking member clear of said abutment to allow free operation of said switch operator subassembly from said one operating position to another.

2. The self-enclosed miniature pivoted-actuator switch with an integral lock claimed in claim 1, wherein:

said means mounting said resilient locking member to said actuator comprises:

a slot in said actuator;

and means at said one end portion of said resilient locking member press-fit into said slot.

3. The self-enclosed miniature pivoted-actuator switch with an integral lock claimed in claim 1, wherein:

said resilient locking member comprises a leaf spring;

and said means mounting said resilient locking member to said actuator comprises:

a slot in said actuator;

a bent-back portion at one end of said leaf spring pressed into said slot;

and the adjacent end tip of said leaf spring being angularly bent to bite into said actuator for good retention in said slot.

4. The self-enclosed miniature pivoted-actuator switch with an integral lock claimed in claim 1, wherein:

said snap-on means comprises a pair of ledges on said actuator, one forward and one rearward with respect to its direction of operation, and a pair of hooks on said operating lever that snap over said ledges to secure said operating lever to said actuator;

and said means mounting said resilient locking member to said actuator comprises a slot extending up into one of said ledges into which said resilient locking member is press-mounted so that an intermediate portion thereof extends out to be engaged by one of said hooks to deflect said other end portion thereof clear of said abutment when said operating lever is snapped onto said actuator.

5. The self-enclosed miniature pivoted actuator switch with an integral lock claimed in claim 4, wherein:

said resilient locking member is a leaf spring provided at its said intermediate portion with a knee shape for engagement by said one hook for effective deflection.

6. A self-enclosed lighted miniature pivoted-actuator switch with an integral lock comprising:

a switch housing having an abutment therewithin;

stationary contact terminals extending from within said housing to the outside;

movable contactor means within said housing selectively operable between different operating positions closing and reopening at least one circuit with respect to said stationary contact terminals;

a lamp mounted within said housing;

lamp contact terminals contacting said lamp and extending to the outside of said housing;

an opening down into said housing;

and a switch operator subassembly extending through said opening down into said housing for operating said movable contactor means comprising:

an actuator pivotally supported within said housing for reciprocal movement to actuate said contactor means and having an aperture up therethrough into which said lamp extends;

a leaf spring mounted to said actuator and normally abutting said abutment to lock said switch in one position;

and a removable operating lever having a manually engageable external portion that it lighted by said lamp;

and snap-on means on said operating lever and complemental snap-on means on said actuator for coupling said operating lever and said actuator, said snap-on means on said operating lever including means for deflecting said leaf spring clear of said abutment for free operation of said switch.

* * * * *